United States Patent [19]

Deutsch

[11] Patent Number: 4,458,572

[45] Date of Patent: Jul. 10, 1984

[54] TONE COLOR CHANGES IN AN ELECTRONIC MUSICAL INSTRUMENT

[75] Inventor: Ralph Deutsch, Sherman Oaks, Calif.

[73] Assignee: Kawai Musical Instrument Mfg. Co., Ltd., Hamamatsu, Japan

[21] Appl. No.: 462,247

[22] Filed: Jan. 31, 1983

[51] Int. Cl.[3] ..... G10H 3/06

[52] U.S. Cl. ..... 84/1.17; 84/1.19; 84/1.24; 84/1.01

[58] Field of Search ..... 84/1.01, 1.03, 1.17, 84/1.19, DIG. 22, 1.24

[56] References Cited

U.S. PATENT DOCUMENTS 4,085,644 4/1978 Deutsch et al. ..... 84/1.01
4,282,786 8/1981 Deutsch et al. ..... 84/1.01

*Primary Examiner*—Forester W. Isen
*Attorney, Agent, or Firm*—Ralph Deutsch

[57] ABSTRACT

An electronic musical instrument having two keyboards is disclosed in which chords detected on the accompaniment keyboard are used to vary the selected tone color of the tones played on the solo keyboard. The solo tones are synthesized by means of a Fourier transform using a set of harmonic coefficients. Selected harmonic coefficients are scaled in magnitude in response to the chord type detected from the notes played on the accompaniment keyboard.

13 Claims, 4 Drawing Figures

TONE COLOR CHANGES IN AN ELECTRONIC MUSICAL INSTRUMENT

BACKGROUND OF THE INVENTION

1. Field of the Invention

This invention relates to electronic musical tone synthesis and in particular is concerned with implementation of solo tone color changes in response to accompaniment chords.

2. Description of the Prior Art

One of the principal attributes of an electronic musical instrument, such as an organ, is the ease with which tone changes can be made. The use of a plurality of keyboards allows the musician to instantaneously change sounds by playing on the keyboards each of which usually controls a different preselected tone color. The tone color is selected for each keyboard by actuating a set of tone switches, or stops, which are arranged in groups which correspond to each of the keyboard arrays of keyswitches. There is a listener emotional need for changing tone colors to prevent a fatigue effect that is associated with a sameness in the aural response of the listener.

Designers of electronic musical instruments have exploited the mechanical-like tone production implementation of keyboard instruments to provide a variety of ancillary systems to aid the neophyte musician. These ancillary systems have a common objective of enabling the new musician to generate tonal effects which usually can only be performed when one has attained a high degree of dexterity on the keyboard. Such ancillary systems include automatic arpeggios, accompaniment chords controlled in preselected rhythmic patterns, automatic pedal accompaniment played in rhythmic patterns, automatic glissandos, and automatic portamento frequency transitions.

Accomplished keyboard instrument players will augment the solo line of a musical piece by adding notes to an otherwise monophonic solo part. This is usually accomplished by inserting notes on the solo keyboard corresponding to notes belonging to the chords that are played on the accompaniment keyboard. The notes added to the solo part, often referred to as "fill-ins," are usually not scored in the written music. The proper selection of fill-notes requires a musical sophistication on the part of the player which is beyond the limitations of the average beginning musician.

Several systems have been developed which add fill-in notes to a keyboard by transferring notes played on an accompaniment keyboard. Such a system is disclosed in U.S. Pat. No. 3,823,246 entitled "Chord Playing Organ Including A Circuit Arrangement For Adding Fill-In Notes To The Solo Part." The patent describes apparatus which in the fill-in mode of operation utilizes the lower, or accompaniment, keyboard of an organ as a monophonic chord input data set of keys. In this mode a single finger is used to actuate a keyboard switch and thereby select a predetermined chord type. The selected chord is sounded for the set of tone switches actuated for the accompaniment keyboard. Two notes of the automatically generated chord are transferred to the solo keyboard and the transferred notes are sounded at the same time that a note is actuated on the solo keyboard. The transferred notes are translated so that they sound in an octave below the actuated solo note. The two transferred notes are selected from the automatically generated chord by using a selection logic which is responsive to the actuated solo note. In this fashion dissonant harmonic intervals can usually be eliminated. Circuitry is provided to inhibit the chord generating apparatus if more than one note is actuated on the lower keyboard.

An improvement to the system disclosed in U.S. Pat. No. 3,823,246 is contained in U.S. Pat. No. 3,990,339 entitled "Electronic Organ And Method Of Operation." The musical effect produced by the disclosed system is very similar to that previously described for U.S. Pat. No. 3,823,246. A time delay is incorporated into the logic so that fill-in notes are automatically inhibited during the execution of notes played in rapid succession on the solo keyboard.

In U.S. Pat. No. 4,368,658 entitled "Apparatus for Solo Harmony Transfer In An Electronic Musical Instrument" apparatus is disclosed for providing fill-in notes. The fill-in notes are chosen by selecting a member of a library of stored chord types. The selected member is one which is closest to the notes played on the accompaniment keyboard. The closest decision is made by processing the actuated keyswitch data with two sets of matched filters. The chord type decision is made to correspond to a matched filter combination which produces a maximum response. A root note is also chosen for the selected chord type. The selected chord type and the chosen root note are used to provide the fill-in notes.

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted to musical waveshapes. A sequence of computation cycles is implemented during each of which a master data set is created using a set of harmonic coefficients which are selected by actuated tone switches and modified in response to chords played on an accompaniment keyboard. At the end of each computation cycle, the computed master data set is stored in a main register.

Following each individual computation cycle, a transfer cycle is initiated during which the stored master data set is transferred to a note register which is an element of each of a number of tone generators. The tone generators are assigned to actuated keyboard switches. The data stored in a note register is repetitively and sequentially read out to a digital-to-analog converter at a rate corresponding to the fundamental frequency associated with its assigned actuated keyboard switch. The output tone generation continues uninterrupted during the computation and transfer cycles.

A chord and root note detect system is used to determine the member of a library of stored chord types which is closest to the notes corresponding to the actuated accompaniment keyboard switches. The chord type information is used to accentuate selected harmonic coefficients read out from a harmonic coefficient memory. The system produces solo keyboard tone colors which vary in response to the actuated accompaniment keyboard switches.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed toward a polyphonic tone generator in which the tone color of notes played on a solo keyboard are varied in response to chords played on an accompaniment keyboard. The tone generator is incorporated into a musical tone generator of the type which synthesizes musical waveshapes by implementing a discrete Fourier transform algorithm. A tone generation system of this variety is described in detail in U.S. Pat. No. 4,085,644 entitled "Polyphonic Tone Synthesizer." This patent is hereby incorporated by reference. In the following description all elements of the system which are described in the referenced patent are identified by two digit numbers which correspond to the same numbered elements appearing in the referenced patent. All system element blocks which are identified by three digit numbers correspond to system elements added to the Polyphonic Tone Synthesizer or correspond to combinations of several elements appearing in the reference patent.

Figure 1:
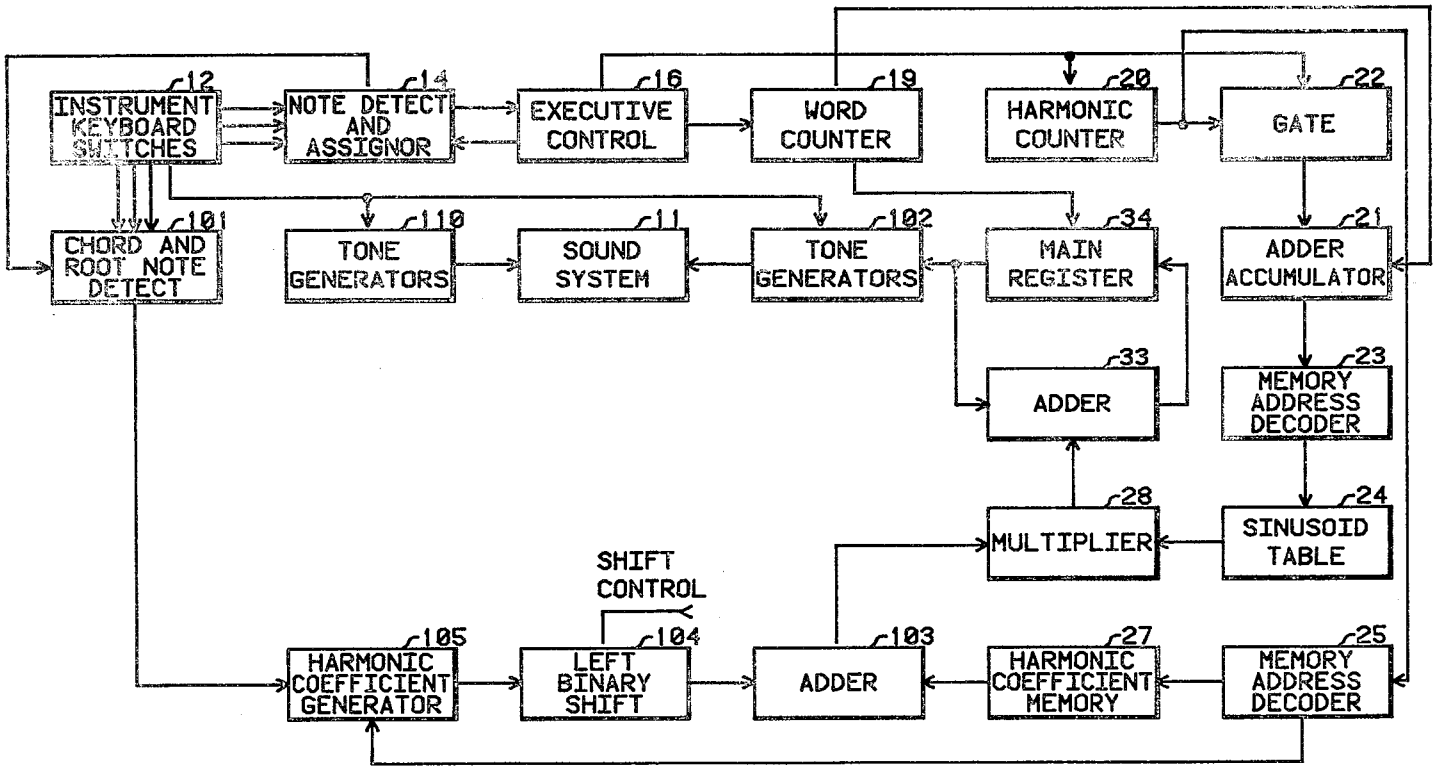
FIG. 1 is a schematic diagram of an embodiment of the invention.

FIG. 1 shows an embodiment of the present invention which is described as a modification and adjunct to the system described in U.S. pat. No. 4,085,644. As described in the referenced patent, the Polyphonic Tone Synthesizer includes an array of keyboard switches 12. The keyboard switches are arranged in multiple linear arrays called keyboards. Generally one keyboard is called the solo, or upper, keyboard; a second keyboard is called the accompaniment, or lower, keyboard; a third keyboard is called the pedal keyboard. In each keyboard, the keyboard switches are arranged in groups which correspond to musical octaves. If one or more of the keyboard switches have a switch status change and are actuated ("on" position) on a keyboard, the note detect and assignor 14 encodes the detected keyboard switch having the status change and stores the corresponding encoded note information for the actuated keyswitches. One member of a set of tone generators, contained in the block labeled tone generators 102, is assigned to each actuated keyswitch.

A suitable note detect and assignor subsystem is described in U.S. Pat. No. 4,022,098 which is hereby incorporated by reference. The note detect and assignor 14 functions as a keyswitch state detect means.

When one or more keyswitches on the keyboards have been actuated, the executive control 16 initiates a repetitive sequence of computation cycles. During each computation cycle, a master data set consisting of 64 data words, or points, is computed in a manner described below and stored in the main register 34. The 64 data words are generated using 32 harmonic coefficients provided at the output from the adder 103.

The 64 data words in the master data set correspond to the amplitudes of 64 equally spaced points of one cycle of the audio waveform for the musical tone produced by a corresponding one of the tone generators 102. The general rule is that the maximum number of harmonics in the audio tone spectra is no more than one-half of the number of data points in one complete waveshape period. Therefore, a master data set comprising 64 data words corresponds to a maximum of 32 harmonics.

At the completion of each computation cycle in the repetitive sequence of computation cycles, a transfer cycle is initated during which the master data set residing in the main register 34 is transferred to each note register corresponding to the tone generators in the tone generators 102 which have been assigned to a keyswitch actuated on the solo keyboard. Each tone generator has an associated note register.

The master data set stored in a note register is read out sequentially and repetitively and transferred to a digital-to-analog converter at a rate determined by a note clock associated with the note register. The note clock timing signals correspond to the fundamental frequency of the musical note associated with the actuated keyswitch to which the corresponding tone generator has been assigned by the note detect and assignor 14.

The note clocks can be implemented in any one of a wide variety of known methods of implementing adjustable frequency timing clocks. Advantageously the note clocks can be implemented as voltage controlled oscillators. One such implementation in the form of voltage controlled oscillators is described in detail in U.S. Pat. No. 4,067,254 which is hereby incorporated by reference.

A digital-to-analog converter is contained in the system block labeled sound system 11. The musical waveshape produced by the digital-to-analog converter is transformed into an audible sound by means of a sound system consisting of a conventional amplifier and speaker subsystem which are also contained in the system block labeled sound system 11.

As described in the referenced U.S. Pat. No. 4,085,644 it is desirable to be able to continuously recompute and store the generated master data sets during a repetitive sequence of computation cycles and to load this data into the associated note registers while the actuated keys remain actuated, or depressed, on the keyboards.

In the manner described in the referenced U.S. Pat. No. 4,085,644, the harmonic counter 20 is initialized to its minimal, or zero, count state at the start of each computation cycle. Each time that the word counter 19 is incremented so that it returns to its initial, or minimal, count state because of its modulo counting implementation, a signal is provided which imcrements the count state of the harmonic counter 20. The word counter 19 is implemented to count modulo 64 which is the number of data words in the master data set which is generated and stored in the main register 34. The harmonic counter 20 is implemented to count modulo 32. This number corresponds to the maximum number of harmonics consistent with a master data set comprising 64 words.

At the start of each computation cycle, the accumulator in the adder-accumulator 21 is initialized to a zero value. Each time that the word counter 19 is incremented, the adder-accumulator adds the current count state of the harmonic counter 20 to the sum contained in the accumulator. This addition is implemented to be modulo 64.

The content of the accumulator in the adder-accumulator 21 is used by the memory address decoder 23 to access trigonometric sinusoid values from the sinusoid table 24. The sinusoid table 24 is advantageously implemented as a read only memory storing values of the trigonometric function $\sin(2\pi\phi/64)$ for $0 \leqq \phi \leqq 64$ at intervals of D. D is a table resolution constant.

The multiplier 28 multiplies the trigonometric value read out of the sinusoid table by harmonic coefficients provided by the adder 103. The product value formed by the multiplier 28 is furnished as one input to the adder 33.

The contents of the main register 34 are initialized to a zero value at the start of a computation cycle. Each time that the word counter 19 is incremented, the content of the main register 34 at an address corresponding to the count state of the word counter 19 is read out and furnished as an input to the adder 33. The sum of the inputs to the adder 33 are stored in the main register 34 at a memory location equal, or corresponding, to the count state of the word counter 19. After the word counter 19 has been cycled for 32 complete count cycles of 64 counts, the main register 34 will contain the master data set.

The keyboard switch contacts for the keyswitches on the accompaniment keyboard are each implemented with two independent contacts. The first contacts are used in the normal manner by the note detect and assignor 14 to assign tone generators 110 to keyswitches actuated on the accompaniment keyboard. The second set of switch contacts are connected in parallel octaves and are used to provide the note input data to the chord and root note detect 101. A parallel octave connection is an arrangement in which the signals transmitted by the switch contact for each note in an octave is summed (logical OR-operation) with the switch contacts for the same notes in each of the other octaves. That is, all C's are summed; all C#'s are summed; and so on for the entire octave.

The chord and root note detect 101 uses the input note data to determine which chord contained in a stored library of chord types is closest to the input set of note data. A one note chord is assumed to be a major chord with the note as the root note of the major chord. A suitable implementation for the chord and root note detect 101 is described in U.S. Pat. No. 4,282,786 entitled "Automatic Chord Type And Root Note Detector." This patent is hereby incorporated by reference.

As described in U.S. Pat. No. 4,282,786, a chord type is selected from a stored library of chord types as the chord type which is closest to the chord actuated on the accompaniment keyboard. The chord type decision is made by successive trial of matched filters to find the first filter that produces a maximum output response. Each matched filter corresponds to a musical chord type. The selection between chord types which yield equal matched filter responses is resolved by a priority logic based upon an assumed frequency of chord usage.

The matched filters used in the chord and root note detect 101 can be stored in memory containing the data shown in Table 1.

TABLE 1

| Musical Note | C | C# | D | D# | E | F | F# | G | G# | A | A# | B |
|---|---|---|---|---|---|---|---|---|---|---|---|---|
| Note Number | 1 | 2 | 3 | 4 | 5 | 6 | 7 | 8 | 9 | 10 | 11 | 12 |
| Chord Type | | | | | | | | | | | | |
| Major (1) | 1 | 0 | 0 | 0 | 1 | 0 | 0 | 1 | 0 | 0 | 0 | 0 |
| Minor (2) | 1 | 0 | 0 | 1 | 0 | 0 | 0 | 1 | 0 | 0 | 0 | 0 |
| Dominant 7th (3) | 1 | 0 | 0 | 0 | 1 | 0 | 0 | 1 | 0 | 0 | 1 | 0 |
| Diminished (4) | 1 | 0 | 0 | 1 | 0 | 0 | 0 | 0 | 0 | 1 | 0 | 0 |
| Augmented (5) | 1 | 0 | 0 | 0 | 1 | 0 | 0 | 0 | 1 | 0 | 0 | 0 |
| Major 7th (6) | 1 | 0 | 0 | 0 | 1 | 0 | 0 | 1 | 0 | 0 | 0 | 1 |

The chord and root note detect 101 provides a 3 bit word output which encodes the selected chord type and a 4 bit word output which encodes the selected root note as a note number.

Figure 2:
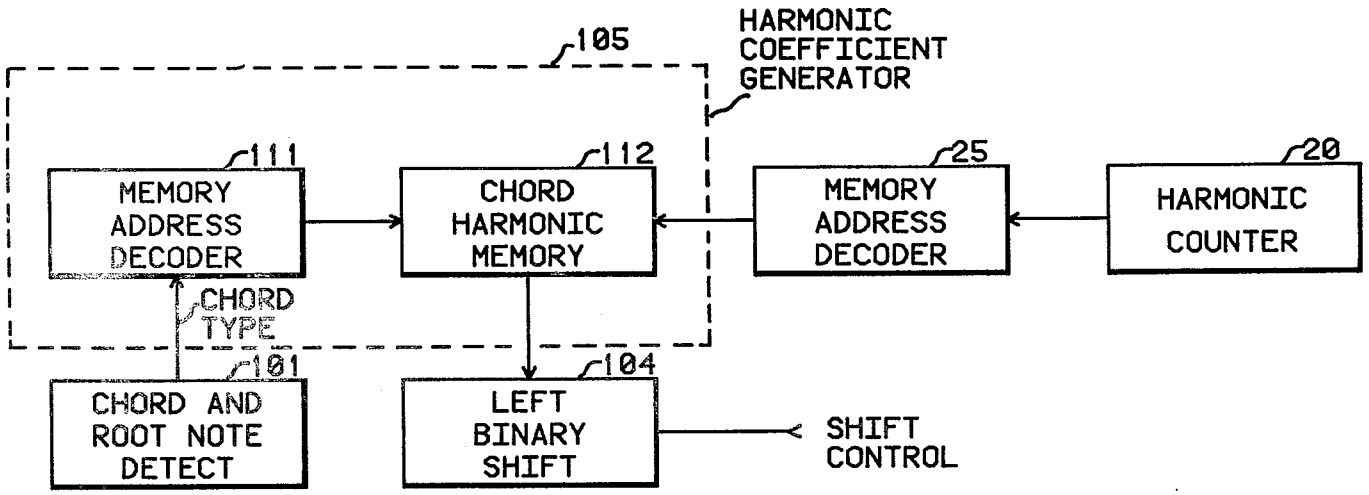
FIG. 2 is a schematic diagram of the harmonic coefficient generator 105.

The details of the harmonic coefficient generator 105 are shown in FIG. 2. The root note information is not used. The memory address decoder 111 decodes the chord type word so that one of a set of six memory areas is selected in the chord harmonic memory 112. The data in a selected area is addressed out by the memory address decoder 25 in response to the count state of the harmonic counter 20. Table 2 lists the data stored in the chord memory 112.

TABLE 2

| Harmonic Accent Coefficients | | | | | | | | | | | | | |
|---|---|---|---|---|---|---|---|---|---|---|---|---|---|
| Chord Address | 1 | 2 | 3 | 4 | 5 | 6 | 7 | 8 | 9 | 10 | 11 | 12 | 13 . . . 32 |
| 1 (Major) | 0 | 0 | 0 | 0 | 1 | 0 | 0 | 1 | 0 | 0 | 0 | 0 | 0 . . . 0 |
| 2 (Minor) | 0 | 0 | 0 | 1 | 0 | 0 | 0 | 1 | 0 | 0 | 0 | 0 | 0 . . . 0 |
| 3 (Dom. 7th) | 0 | 0 | 0 | 0 | 1 | 0 | 0 | 1 | 0 | 0 | 1 | 0 | 0 . . . 0 |
| 4 (Dim.) | 0 | 0 | 0 | 1 | 0 | 0 | 1 | 0 | 0 | 1 | 0 | 0 | 0 . . . 0 |
| 5 (Aug.) | 0 | 0 | 0 | 0 | 1 | 0 | 0 | 0 | 1 | 0 | 0 | 0 | 0 . . . 0 |
| 6 (Major 7th) | 0 | 0 | 0 | 0 | 1 | 0 | 0 | 1 | 0 | 0 | 0 | 1 | 0 . . . 0 |

A "1" entry in Table 2 indicates that the corresponding harmonic for an input chord type will be accentuated for the tone generated for the tone generators assigned to the solo keyboard. The data stored in the chord harmonic memory 112 comprises a set of scale coefficients.

The left binary shift 104 is used as a data scalor to scale the magnitude of the data words addressed out from the chord harmonic memory 112.

The output harmonic coefficient from the left binary shift 104 is summed with the harmonic coefficient simultaneously accessed out from the harmonic coefficient memory 27 by the memory address decoder. The net result is that certain selected harmonic coefficients are accentuated in response to the chord actuated on the accompaniment keyboard.

The particular data stored in the chord harmonic memory 112 will generate tones that approximate the addition of a chord to a single solo note. Because modern keyboard musical instruments are designed to sound the equal tempered musical scale, it is not possible to accentuate harmonics in such a fashion that the result is exactly equivalent to adding a musical tone. However, the illustrative data set shown in Table 2 will provide an acceptable approximation to chords. Table 3 lists the approximate chords that are generated by the harmonic accentuation subsystem.

TABLE 3

| Chord Type | True Chord | Pseudo Chord |
|---|---|---|
| Major | $C_4$ $E_4$ $G_4$ | $C_4$ $E_6(-13.7)$ $C_7$ |
| Minor | $C_4$ $D\#_4$ $G_4$ | $C_4$ $C_6$ $C_7$ |
| Dom. 7th | $C_4$ $E_4$ $G_4$ $A\#_4$ | $C_4$ $E_6(-13.7)$ $C_7C\#_7(-48.7)$ |
| Aug. 5 | $C_4$ $E_4$ $G\#_4$ | $C_4$ $E_6(-13.7)$ $D_7(3.9)$ |
| Dim. | $C_4$ $D\#_4$ $F\#_4$ $A_4$ | $C_4$ $C_6$ $G_6(1.9)$ $E_7(-13.7)$ |
| Maj. 7th | $C_4$ $E_4$ $G_4$ $B_4$ | $C_4$ $E_6(-13.7)$ $C_7$ $G_7(1.9)$ |

The entries in the parentheses list the error in frequency from the indicated true musical note measured in cents.

Various modifications of the basic system are possible. For example the shift control signal can be made to vary with time using a time varying source such as the ADSR (attack/decay/sustain/release) envelope function. The left binary shift 104 can be implemented as a multiplier so that changes can be made in steps of less than 6 db. The data stored in the chord harmonic memory can be selected so that other combinations of harmonics can be accentuated. By using data words other than "1" and "0", a wider variation can be implemented for the resultant harmonic accentuation.

The present invention can also be incorporated into other tone generators of the type which synthesize musical waveshapes by implementing a Fourier-type transformation employing a selected set of harmonic coefficients. A system of this variety is described in U.S. Pat. No. 3,809,786 entitled "Computor Organ." This patent is hereby incorporated by reference.

Figure 3:
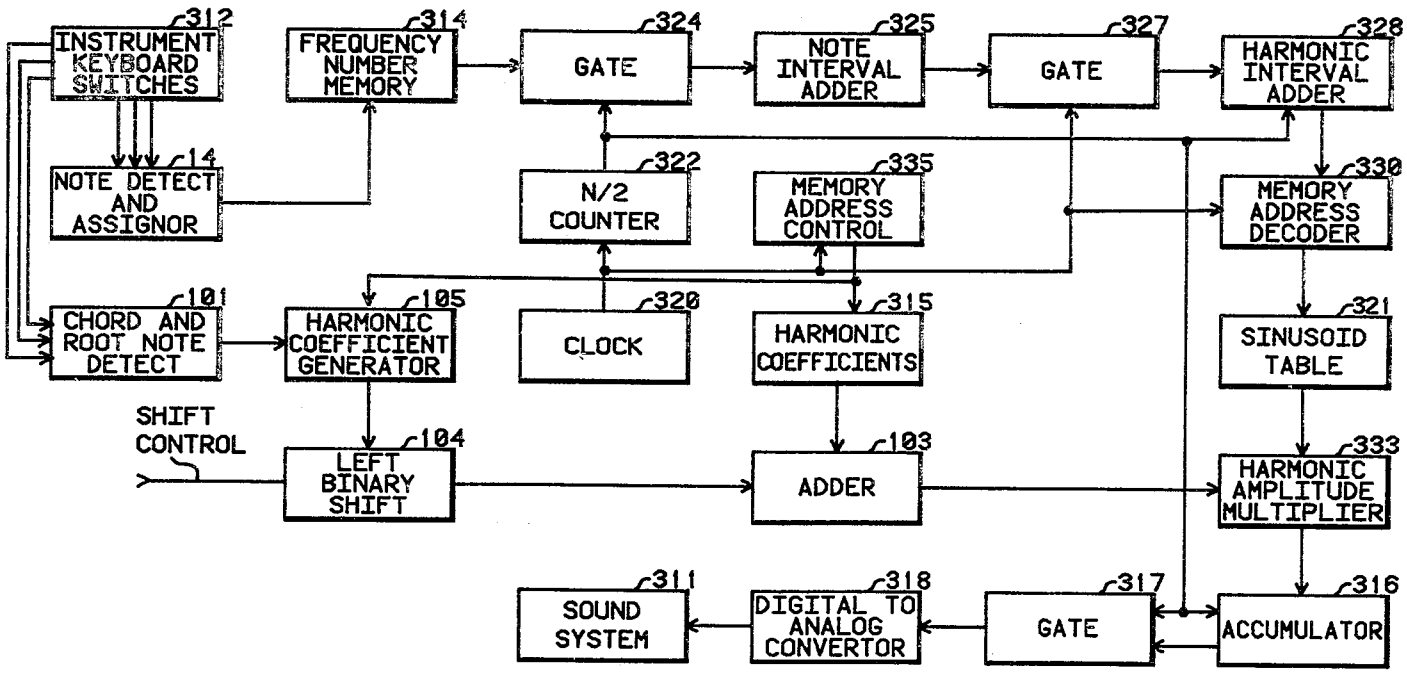
FIG. 3 is a schematic diagram of an alternative embodiment of the invention.

FIG. 3 illustrates a tone generator system which incorporates the present invention into the Computor Organ described in the referenced patent. The system blocks shown in FIG. 3 are numbered to be 300 plus the corresponding block numbers shown in FIG. 1 of the referenced patent.

A closure of a keyswitch contained in the instrument keyboard switches 312 causes a corresponding frequency number to be accessed out from the frequency number memory 314. The accessed frequency number is added repetitively to the contents of the note interval adder 325. The contents of the note interval adder 325 specifies the sample point at which a waveshape amplitude is calculated. For each sample point, the amplitudes of a number of harmonic components are calculated individually by multiplying harmonic coefficient values furnished by the adder 103 by trigonometric sinusoid values read out from the sinusoid table 321. The harmonic component amplitudes are summed algebraically in the accumulator 316 to obtain the net amplitude at a waveshape sample point. The sample point amplitudes are converted into an analog signal by means of the digital-to-analog converter 318 and then furnished to the sound system 311.

The sinusoid table 321 stores values of the trigonometric function $\sin(2\pi n/64)$. These function values correspond to a waveshape having 64 points per period for the highest fundamental frequency musical pitch generated by the system.

The chord and root note detect 101, the harmonic coefficient generator 105, the left binary shift 104, and the adder 103 function in the manner previously described for the system shown in FIG. 1.

Figure 4:
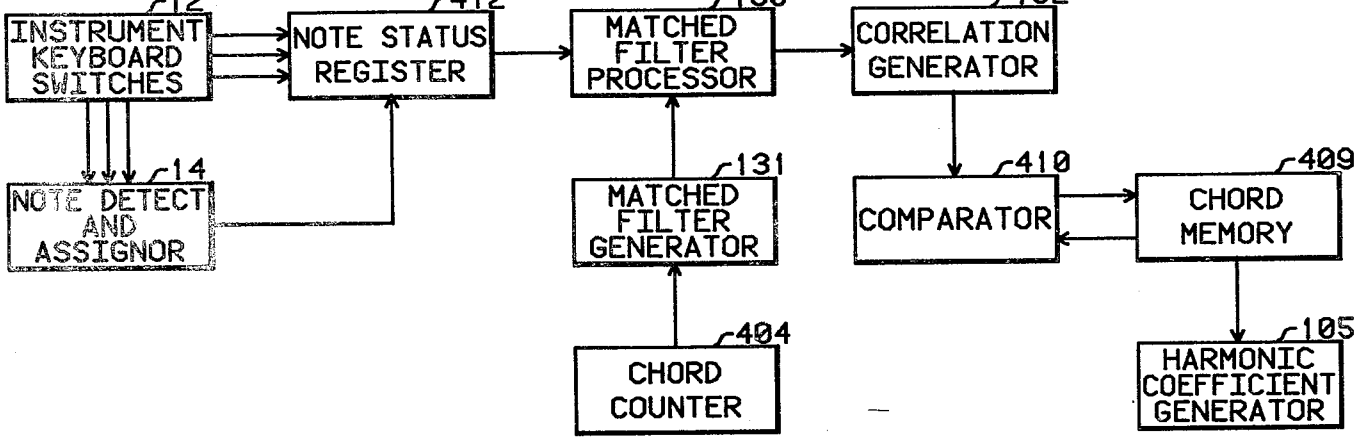
FIG. 4 is a schematic diagram of the chord and root note detect 101.

A polyphonic tone generator is implemented by time sharing the functions previously described in a sequence of time slots. Each time slot corresponds to a detected acuated keyswitch and thus to an individual tone generator. The accumulator 316 sums the computations of points for one sequence of time slots and the combined data point is furnished to the digital-to-analog convertor 318. FIG. 4 is a schematic diagram of the chord and root note detect 101. The system blocks in the 400 number series are 400 plus the corresponding blocks shown in FIG. 1 of the previously referenced U.S. Pat. No. 4,282,786.

The input data for the actuated keyboard switches connected in parallel octaves is detected by the note detect and assignor 14 and stored in the note status register 12. The stored data in the note status register 12 is converted into a time domain signal by sequentially reading out the data words which are transferred to the matched filter processor 130.

The chord counter 404 in essence causes a sequence of prestored library of matched filters to be created by the matched filter generator 131. In FIG. 1 of the referenced patent, the correlation logic 7 is the counterpart of the matched filter generator 131. The matched filter processor 130 performs a bit-by-bit multiplication of each bit of the sequence of data transferred by the note status register 412 by the bits of the matched filter created by the matched filter generator 131. The output of the bit-by-bit multiplication is summed by the correlation generator 132 to form a correlation number.

The matched filter processor 130 and the correlation generator in FIG. 1 of the referenced patent consist of the set of AND-gates 23A to 23L, the OR-gate 24 and the correlation counter 8.

The correlation number created by the correlation generator 132 is compared by means of the comparator 410 with a correlation number stored in the chord memory 409. Each correlation number stored in the chord memory is associated with one of the prestored library of matched filters. Each element of this library corresponds to a musical chord type. If the stored correlation number is equal to or greater than the new correlation number, no change is made of the data stored in the chord memory 409. If the stored correlation number is less than the new correlation number, the new correlation number and the identification of the corresponding musical chord type is stored in the chord memory 409. Ties in the magnitude of the correlation number are resolved by a priority scheme implemented by the order in which the matched filters are generated in response to the chord counter 404. The musical chord type remaining in the chord memory after the sequence of matched filter processing is the selected chord type data word corresponding to the keyswitches acuated on the accompaniment keyboard.

I claim:

1. In a keyboard musical instrument having a first and second keyboard array of keyswitches, in which a plurality of data words corresponding to the amplitudes of points defining the waveform of a musical tone are computed during a computation cycle and transferred sequentially to a digital-to-analog converter to be converted into musical waveshapes, apparatus for varying the spectral composition of notes played by actuating keyswitches on said first keyboard array of keyswitches in response to notes played by actuating keyswitches on said second keyboard array of keyswitches comprising;

a first detection means for detecting actuated keyswitches in said first keyboard array of keyswitches, a second detection means for detecting actuated keyswitches in said second keyboard array of keyswitches and wherein a detect signal is generated in response to each detected actuated keyswitch, a chord memory means for storing a multiplicity of chord type data words each of which corresponds to a musical chord type, a chord addressing means for reading out chord type data words stored in said chord memory, a chord detect means responsive to actuated keyswitches detected by said second detection means whereby one of said chord type data words read out from said chord memory means is selected, a waveshape memory means, a means for computing responsive to said selected chord type data word whereby said plurality of data words corresponding to said amplitudes of points defining the waveform of a musical tone are computed and stored in said waveshape memory means during a computation cycle, and a plurality of tone generators for creating musical tones from data words stored in said waveshape memory in response to actuated keyswitches detected by said first detection means.

2. In a musical instrument according to claim 1 wherein said chord detect means comprises;

a keyswitch status memory means for storing each said detect signal generated by said second detection means, a matched filter means whereby a matched filter is created in response to each said chord type data word read out from said chord memory means, a matched filter processor means wherein data stored in said keyswitch status memory is processed by each said created matched filter thereby generating a plurality of correlation numbers, and a decision means responsive to said plurality of correlation numbers wherein a selection is made of the chord type data word which causes the generation of a correlation number having a maximum value.

3. A musical instrument according to claim 2 wherein said decision means comprises;

priority assignment means wherein said plurality of chord type data words are assigned priority values, and priority selection means responsive to said assigned priority values wherein a priority selection is made between two said chord type data words which cause the generation of correlation numbers having equal values thereby selecting the chord type data word corresponding to the largest of said assigned priority values.

4. A musical instrument according to claim 1 wherein said means for computing comprises;

a coefficient memory means for storing a plurality of harmonic coefficients, a coefficient addressing means for reading out harmonic coefficients from said coefficient memory means, a harmonic scaler means responsive to said selected chord type data word whereby the harmonic coefficients read out from said coefficient memory means are scaled by preselected harmonic scale factors to form a plurality of scaled harmonic coefficients, and a waveshape generator means responsive to said plurality of scaled harmonic coefficients whereby said plurality of data words corresponding to said amplitude of points defining the waveform of a musical tone are computed and stored in said waveform memory means during said computation cycle.

5. A musical instrument according to claim 4 wherein said waveshape generator means comprises;

a logic clock means for providing logic timing signals, a word counter for counting said logic timing signals modulo the number of said plurality of data words stored in said waveshape memory means, a harmonic counter incremented each time said word counter returns to its minimal count state, an adder-accumulator means wherein the count state of said harmonic counter is successively added to the content of an accumulator in response to said logic timing signals and wherein the content of said accumulator is initialized to a zero value at the start of a computation cycle, a sinusoid table storing a set of trigonometric function values, a sinusoid table addressing means responsive to the content of said adder-accumulator means for reading out a trigonometric function value from said sinusoid table, a multiplying means for multiplying said read out trigonometric value by one of said plurality of scaled harmonic coefficients to form an output product data value, and a means for successively summing said output data value with data words read out from said waveshape memory means and whereby the summed value is stored in said waveshape memory means.

6. A musical instrument according to claim 4 wherein said harmonic scaler means comprises;

a scale coefficient memory means for storing a plurality of sets of harmonic scale factors, a scale coefficient addressing means whereby one of said sets of harmonic scale factors is selected in response to said selected chord type data word and whereby each element of the selected set of harmonic scale factors is read out in response to said scale coefficient addressing means, and a combiner means whereby each of said harmonic coefficients read out of said coefficient memory means is scaled by a corresponding one of said harmonic scale factors read out of said scale coefficient memory means thereby forming one of said plurality of scaled harmonic coefficients.

7. In a keyboard musical instrument having a first and a second keyboard array of keyswitches in which a plurality of data words are computed at regular time intervals corresponding to the combination of a number of tone generators and converted into musical waveshapes, apparatus for varying the spectral composition of notes played by actuating keyswitches on said first keyboard array of keyswitches in response to notes played by actuating keyswitches on said second keyboard array of keyswitches comprising;

a first detection means for detecting actuated keyswitches in said first keyboard array of keyswitches, a second detection means for detecting actuated keyswitches in said second keyboard array of keyswitches and wherein a detect signal is generated in response to each detected actuated keyswitch of said second keyboard, a chord detect means responsive to each said detect signal whereby a chord type data word is generated, a means for computing, responsive to said chord type data word and responsive to actuated keyswitches detected by said first detection means, for computing at regular time intervals a sequence of data words each of which represents said combination of a number of tone generators, and a means for producing musical waveshapes from said sequence of data words, said waveshapes having pitches determined by said first detection means.

8. In a musical instrument according to claim 7 wherein said chord detect means comprises;

a chord memory means for storing a multiplicity of chord type data words each of which corresponds to a musical chord type, a chord addressing means for reading out chord type data words stored in said chord memory means, a matched filter means whereby a matched filter is created in response to each chord type data word read out from said chord memory means, a keyswitch status memory means for storing each said detect signal generated by said second detection means, a matched filter processor means wherein data stored in said keyswitch status memory means is processed by each said created matched filter thereby generating a plurality of correlation numbers, and a decision means responsive to said plurality of correlation numbers wherein a selection is made of the chord data type word which causes the generation of a correlation number having a maximum value.

9. A musical instrument according to claim 8 wherein said decision means comprises;

priority assignment means wherein said plurality of chord type data words are assigned priority values, and priority selection means responsive to said assigned priority values wherein a priority selection is made between two said chord type data words which cause the generation of correlation numbers having equal values thereby selecting the chord type data word corresponding to the largest of said assigned priority values.

10. A musical instrument according to claim 7 wherein said means for computing comprises;

a coefficient memory means for storing a plurality of harmonic coefficients, a coefficient addressing means for reading out harmonic coefficients from said coefficient memory means, a harmonic scaler means responsive to said selected chord type data word whereby the harmonic coefficients read out from said coefficient memory means are scaled by preselected harmonic scale factors to form a plurality of scaled harmonic coefficients, and an amplitude generating means responsive to said plurality of scaled harmonic coefficients whereby set sequence of data words each of which corresponds to a combination of tone generators is generated.

11. A musical instrument according to claim 10 wherein said amplitude generating means comprises;

a means for obtaining a frequency number, a note interval adder wherein said frequency number is successively added to the sum previously contained in said interval adder, a harmonic interval adder cleared before each computation of one of said sequence of data words wherein the content of said note interval adder is added to the contents previously in said harmonic interval adder, a sinusoid table for storing a plurality of trigonometric sinusoid values, an address decoder means responsive to the contents of said harmonic interval adder for reading out trigonometric sinusoid values from said sinusoid table, a multiplier means for multiplying the trigonometric sinusoid values read out from said second sinusoid table by said scaled harmonic coefficients, and a means for successively summing the output from said multiplier means thereby creating said sequence of data words each of which corresponds to a combination of tone generators.

12. A musical instrument according to claim 10 wherein said harmonic scaler means comprises;

a scale coefficient memory means for storing a plurality of sets of harmonic scale factors, a scale coefficient addressing means whereby one of said sets of harmonic scale factors is selected in response to said selected chord type data word and whereby each element of said selected set of harmonic scale factors is read out in response to said scale coefficient addressing means, and a combiner means whereby each of said harmonic coefficients read out of said coefficient memory means is scaled by a corresponding one of said harmonic scale factors read out of said scale coefficient memory means thereby forming one of said plurality of scaled harmonic coefficients.

13. In a keyboard musical instrument having a first and a second keyboard array of keyswitches wherein musical tone are synthesized by evaluating the constituent Fourier components of a musical waveshape, apparatus for varying the spectral composition of notes played by actuating keyswitches on said first keyboard array of keyswitches in response to notes played by actuating keyswitches on said second keyboard array of keyswitches comprising;

a first detection means for detecting actuated keyswitches in said first keyboard array of keyswitches, a second detection means for detecting actuated keyswitches in said second keyboard array of keyswitches and wherein a detect signal is generated in response to each detected actuated keyswitch of said second keyboard, a chord detect means responsive to said detect signals whereby a musical chord type data word is generated, a means for computing responsive to said musical chord type data word wherein said constituent Fourier components of a musical waveshape are computed in response to actuated keyswitches detected by said first detection means, and a means for producing musical waveshapes from said constituent Fourier components of a musical waveshape, said waveshapes having pitches determined by said first detection means.

* * * * *